US008265529B2

(12) United States Patent
Mori et al.

(10) Patent No.: US 8,265,529 B2
(45) Date of Patent: Sep. 11, 2012

(54) CONFIGURATION OF A DEVELOPING DEVICE BLADE AND IMAGE FORMING APPARATUS

(75) Inventors: Hiroki Mori, Nagoya (JP); Hiroshi Handa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 188 days.

(21) Appl. No.: 12/693,023

(22) Filed: Jan. 25, 2010

(65) Prior Publication Data

US 2010/0189472 A1 Jul. 29, 2010

(30) Foreign Application Priority Data

Jan. 26, 2009 (JP) ..... 2009-014251

(51) Int. Cl.
*G03G 15/08* (2006.01)

(52) U.S. Cl. ..... 399/284

(58) Field of Classification Search ..... 399/284, 399/274

See application file for complete search history.

(56) References Cited

U.S. PATENT DOCUMENTS

| | | | | |
|---|---|---|---|---|
| 2004/0247346 | A1* | 12/2004 | Nakagawa | 399/284 |
| 2008/0131174 | A1* | 6/2008 | Inoue et al. | 399/284 |

FOREIGN PATENT DOCUMENTS

| | | | |
|---|---|---|---|
| JP | 08-240988 | | 9/1996 |
| JP | 11344858 | A | 12/1999 |
| JP | 2006-154542 | | 6/2006 |
| JP | 2008-139552 | | 6/2008 |
| KR | 2005-0073117 | * | 7/2005 |

OTHER PUBLICATIONS

The First Office Action for Chinese patent application No. 201010113301.7 mailed Jan. 31, 2012.

* cited by examiner

*Primary Examiner* — Walter L Lindsay, Jr.
*Assistant Examiner* — Billy J Lactaoen
(74) *Attorney, Agent, or Firm* — Banner & Witcoff, Ltd.

(57) ABSTRACT

A developing device include: a case; a developing roller supported by the case to be rotatable in a rotational direction; and a blade including a base end supported by the case and a tip end provided upstream of the base end in the rotational direction and contacting the surface of the developing roller at a contact portion to regulate a thickness of the toner on the developing roller. The blade further includes a bent portion that is bent from the contact portion at a radius of curvature from 0.2 mm to 0.4 mm to be separated from the developing roller as extending toward the tip end. An angle defined between a segment connecting the contact portion with a center of curvature of the bent portion and a segment connecting the tip end with the center of curvature of the bent portion is in the range from 45° to 90°.

7 Claims, 6 Drawing Sheets

CONFIGURATION OF A DEVELOPING DEVICE BLADE AND IMAGE FORMING APPARATUS

CROSS-REFERENCE TO RELATED APPLICATION

This application claims priority from Japanese Patent Application No. 2009-014251, filed on Jan. 26, 2009, the entire subject matter of which is incorporated herein by reference.

TECHNICAL FIELD

Aspects of the present invention relate to a developing device that is provided in an image forming apparatus such as a laser printer and an image forming apparatus.

BACKGROUND

A developing device is provided in an image forming apparatus and develops an electrostatic latent image formed on a photosensitive member. The developing device includes a toner storage chamber in which toner is stored, a supply roller that is disposed below the toner storage chamber, a developing roller that is rotatable in a rotational direction while being in contact with a photosensitive member and the supply roller, and a layer thinning blade that is in contact with the outer peripheral surface of the developing roller over an axial direction of the developing roller.

The layer thinning blade is made of elastic metal and has a plate shape. The layer thinning blade includes a base end that is supported by a case of the developing device, and a tip end that is provided upstream of the base end in the rotational direction of the developing roller. The tip end of the layer thinning blade has a bent portion that is bent at a predetermined radius of curvature to be separated from the surface of the developing roller toward the edge of the tip end of the layer thinning blade. The bent portion of the layer thinning blade is in contact with the surface of the developing roller.

In the developing device, the toner stored in the toner storage chamber drops on the supply roller and is then supplied to the surface of the developing roller by the supply roller. The developing roller rotates in the predetermined direction, conveys the toner, which is supplied to the surface of the developing roller, to a contact position where the developing roller is in contact with the bent portion of the layer thinning blade, and then conveys the toner to a contact position where the developing roller is in contact with the photosensitive member. Accordingly, toner is supplied to an electrostatic latent image, which is formed on the photosensitive member, at the contact position where the developing roller is in contact with the photosensitive member, so that the electrostatic latent image is visualized into a toner image.

Here, when the toner, which is supplied to the surface of the developing roller, passes through the contact position where the developing roller is in contact with the bent portion of the layer thinning blade, the thickness of the toner is regulated by the layer thinning blade. Accordingly, a thin toner layer is formed and held on the surface of the developing roller. As the thickness of the toner is regulated by the layer thinning blade, the toner is accumulated on the upstream side (hereinafter, simply referred to as an "upstream side of the bent portion") of the bent portion in the rotational direction of the developing roller.

Since the toner is accumulated on the upstream side of the bent portion, a stable amount of toner passes through the contact position where the developing roller is in contact with the bent portion of the layer thinning blade. Accordingly, after passing through the contact position where the developing roller is in contact with the bent portion of the layer thinning blade, an inappropriately thin portion can be reduced or prevented from being formed in the thin toner layer that is held on the surface of the developing roller. Accordingly, it is possible to achieve a solid print without a scratched portion.

However, in the above-described developing device, a toner density in the toner image based on the thin toner layer formed through the layer thinning blade on the surface of the developing roller can vary, so that a so called ghost is generated.

SUMMARY

Accordingly, it is an aspect of the present invention to provide a developing device and an image forming apparatus that can suppress the generation of a ghost caused by a blade while achieving a solid print without a scratched portion.

According to an exemplary embodiment of the present invention, there is provided a developing device comprising: a case; a developing roller that is supported by the case to be rotatable in a rotational direction about a rotating axis, and is configured to hold toner on an outer peripheral surface thereof to supply the toner to an electrostatic latent image formed on a photosensitive member; and a blade that includes a base end supported by the case and a tip end provided upstream of the base end in the rotational direction, and is in contact with the outer peripheral surface of the developing roller at a contact portion between the base end and the tip end so as to regulate a thickness of the toner held on the developing roller. The blade further includes a bent portion that is provided between the tip end and the contact portion, and that is bent from the contact portion as a bending start portion at a radius of curvature from 0.2 mm to 0.4 mm to be separated from the outer peripheral surface of the developing roller as extending toward the tip end. As seen in a direction along the rotating axis of the developing roller, an angle defined between a first reference segment which connects the contact portion with a center of curvature of the bent portion and a second reference segment which connects the tip end with the center of curvature of the bent portion is in the range from 45° to 90°.

According to another exemplary embodiment of the present invention, there is provided an image forming apparatus comprising a photosensitive member and the above-described developing device.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Figure 1:
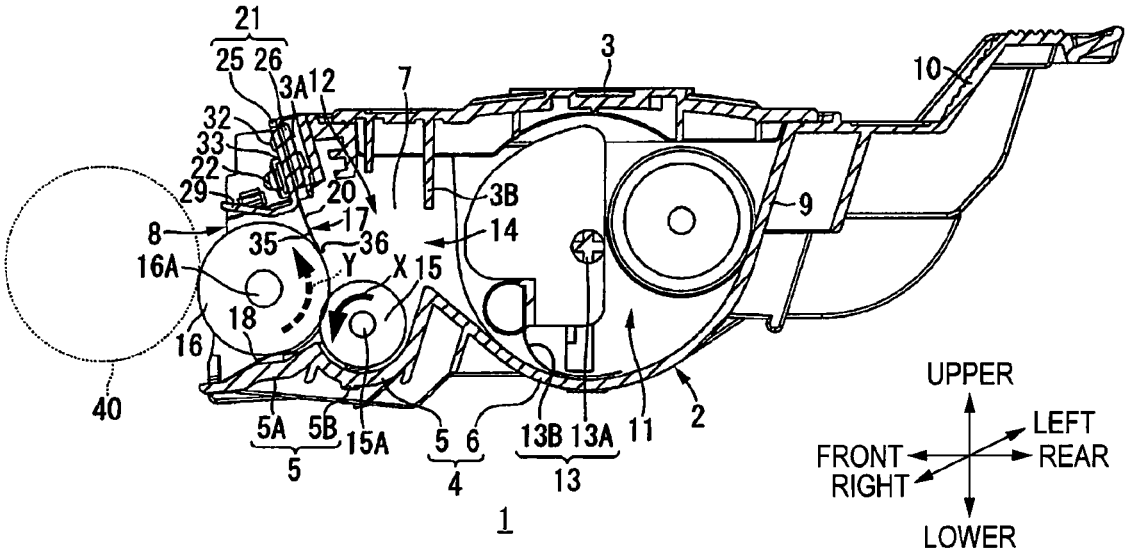
FIG. 1 is a right cross-sectional view showing a developing cartridge as an example of a developing device according to an exemplary embodiment of the present invention.

Exemplary embodiments of the present invention will be described with reference to FIGS. 1 to 6. A developing cartridge 1 is shown in FIG. 1 as an example of a developing device according to an exemplary embodiment of the present invention. For ease of discussion, in the following description, the top or upper side, the bottom or lower side, the left or left side, the right or right side, the front or front side, and the rear or rear side of the developing device are identified as indicated by the arrows in drawings. Further, the left-right direction is also referred to as a width direction, and the upper-lower direction is also referred to as a vertical direction. The left-right direction and the front-rear direction are also referred to as a horizontal direction.

1. Structure of Developing Cartridge

The developing cartridge 1 shown in FIG. 1 is provided in an electrophotographic image forming apparatus (not shown) or the like. Here, the image forming apparatus includes a photosensitive member 40 such as a photosensitive drum on which an electrostatic latent image is formed, and the developing cartridge 1 supplies toner to the electrostatic latent image formed on the photosensitive member 40 to develop the electrostatic latent image. The developed electrostatic latent image (toner image) is transferred to a sheet from the photosensitive member 40 and then fixed to the sheet, so that an image is formed on the sheet in the image forming apparatus.

The developing cartridge 1 includes a case 2 that has a hollow box shape. The case 2 is long, for example, in the width direction (see FIG. 5), and the upper and lower portions of the case are substantially flat, and includes a top wall 3, a bottom wall 4, a rear wall 9, and left and right side walls 7.

The top wall 3 is substantially flat in the horizontal direction. An inclined wall 3A, which is inclined toward the rear lower side, is integrally formed at each of both end portions of the front end of the top wall 3 in the width direction (see also FIG. 5). A vertical wall 3B, which extends downward from the lower surface of the top wall 3 in a substantially vertical direction, is integrally formed at a portion of the top wall 3 that is deviated toward the front side from the middle of the top wall in the front-rear direction.

The bottom wall 4 of the case 2 extends in the front-rear direction while being partially curved as seen in the width direction. Specifically, the bottom wall 4 integrally includes a front bottom wall 5 that is provided on the front side thereof and a rear bottom wall 6 that is provided on the rear side thereof.

As seen in the width direction, the front bottom wall 5 has a first portion 5A that extends from the front end thereof toward the substantially rear upper side, and a second portion 5B that extends toward the rear side while being curved in an arc shape so as to protrude downward, and a portion which extends toward the rear upper side. The rear end of the front bottom wall 5 and the vertical wall 3B of the top wall 3 are positioned at substantially the same position in the front-rear direction. Here, in the case 2, a predetermined gap is formed between the rear end of the front bottom wall 5 and the lower end of the vertical wall 3B and forms a communication port 14.

As seen in the width direction, the rear bottom wall 6 continues to the rear end of the front bottom wall 5 and extends toward the rear side while being largely curved in an arc shape so as to protrude downward.

A supply port 8, which is surrounded by the front end edge of the top wall 3, the front end edge of the bottom wall 4 (front bottom wall 5), and the front end edges of the left and right side walls 7 of the case 2, is formed at the front side of the case 2. The supply port 8 is long in the width direction.

The rear wall 9 of the case 2 connects the rear end of the top wall 3 to the rear end of the bottom wall 4 (rear bottom wall 6), and substantially linearly extends from the rear end of the bottom wall 4 to the rear end of the top wall 3 toward the rear upper side. A grip part 10 is formed integrally with the rear wall 9. The grip part 10 protrudes from the upper end portion of the rear wall 9 toward the rear side. The entire developing cartridge 1 can be moved by gripping the grip part 10 so as to be mounted in or detached from the image forming apparatus (not shown).

The inside of the case 2 is partitioned into a toner storage chamber 11, which is provided on the rear side, and a developing chamber 12, which is provided on the front side, by the vertical wall 3B of the top wall 3. The toner storage chamber 11 and the developing chamber 12 communicate with each other through the communication port 14.

The toner storage chamber 11 is partitioned in the upper-lower direction by the top wall 3 and the rear bottom wall 6, and is partitioned in the front-rear direction by the vertical wall 3B and the rear wall 9.

An agitator 13 is provided in the toner storage chamber 11. The agitator 13 includes a rotating shaft 13A that passes through a portion substantially corresponding to the center of curvature of the rear bottom wall 6 and extends along a rotating axis in the width direction, and an agitating blade 13B that has a center at the rotating shaft 13A and extends from the rotating shaft 13A in the radial direction. The agitator 13 is rotatable about the rotating shaft 13A in the toner storage chamber 11. A driving force is input to the rotating shaft 13A from the image forming apparatus (not shown) during the formation of an image, so that the agitator 13 rotates in a clockwise direction as seen from the right side.

Positively chargeable non-magnetic one-component pulverized toner, which is produced by a so-called pulverization method, is stored in the toner storage chamber 11.

The developing chamber 12 is partitioned in the upper-lower direction by a front portion of the top wall 3 than the vertical wall 3B and the front bottom wall 5. The rear end of the developing chamber 12 is partitioned by the vertical wall 3B. The above-described supply port 8 communicates with the developing chamber 12 from the front side.

A supply roller 15, a developing roller 16 and a blade unit 17 are provided in the developing chamber 12. The developing roller 16 has a diameter larger than that of the supply roller 15.

The supply roller 15 extends in the width direction. The lower portion of the outer peripheral surface of the supply roller 15 is disposed along the curved second portion 5B of the front bottom wall 5. The supply roller 15 opposes the communication port 14 from the front lower side.

Further, the supply roller 15 is installed between the left and right side walls 7 of the case 2, and is rotatably supported by the left and right side walls 7. That is, a rotating shaft 15A of the supply roller 15 extends along a rotating axis in the width direction. In this state, a driving force is input to the rotating shaft 15A from the image forming apparatus (not shown) during the formation of an image, so that the supply roller 15 rotates in a counterclockwise direction X (an arrow shown by a thick solid line) as seen from the right side.

The rotating shaft 15A of the supply roller 15 is made of, for example, metal and the rotating shaft 15A is coated with a conductive foam material.

The developing roller 16 extends in the width direction. The lower portion of the outer peripheral surface of the developing roller 16 is disposed adjacent to the first portion 5A of the front bottom wall 5 from above. The front portion of the outer peripheral surface of the developing roller 16 is exposed to the front side of the case 2 through the supply port 8, and is configured to be in contact with the surface of the photosensitive member 40 from the rear side. The gap between the lower portion of the outer peripheral surface of the developing roller 16 and the first portion 5A is closed by, for example, a film-shaped seal 18.

The developing roller 16 is in contact with the supply roller 15 from the front upper side. A portion of the outer peripheral surface of the developing roller 16 that is in contact with the supply roller 15, and a portion of the outer peripheral surface of the supply roller 15 that is in contact with the developing roller 16 are compressed against each other.

Further, the developing roller 16 is installed between the left and right side walls 7 of the case 2, and is rotatably supported by the left and right side walls 7. That is, a rotating shaft 16A of the developing roller 16 extends along a rotating axis in the width direction, and a direction of the rotating shaft of the developing roller 16 is the width direction. In this state, a driving force is input to the rotating shaft 16A from the image forming apparatus (not shown) during the formation of an image, so that the developing roller 16 rotates in a predetermined direction, specifically, in a counterclockwise direction Y (see an arrow shown by a thick broken line) as seen from the right side.

Here, the rotating shaft 16A of the developing roller 16 is made of, for example, metal, and the rotating shaft 16A is coated with a conductive rubber material. During the formation of an image, a developing bias is applied to the developing roller 16 from the image forming apparatus (not shown).

The blade unit 17 is disposed above the developing roller 16, and is provided on the left and right inclined walls 3A (see also FIG. 5) that are provided at the front end of the top wall 3 of the case 2.

Figure 2A:
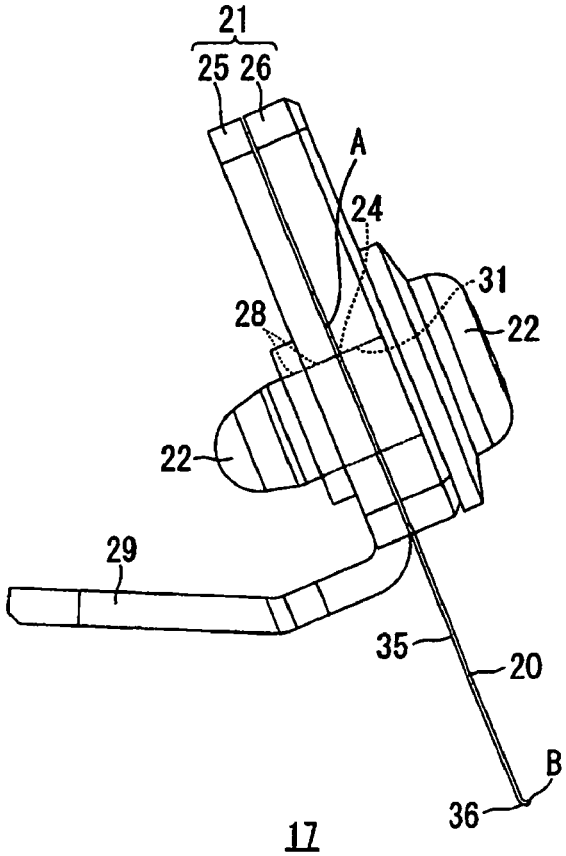
FIG. 2A is a view showing a blade unit of FIG. 1.

As shown in FIG. 2A, the blade unit 17 includes a blade 20, a pair of holders 21, and screws 22.

Figure 4:
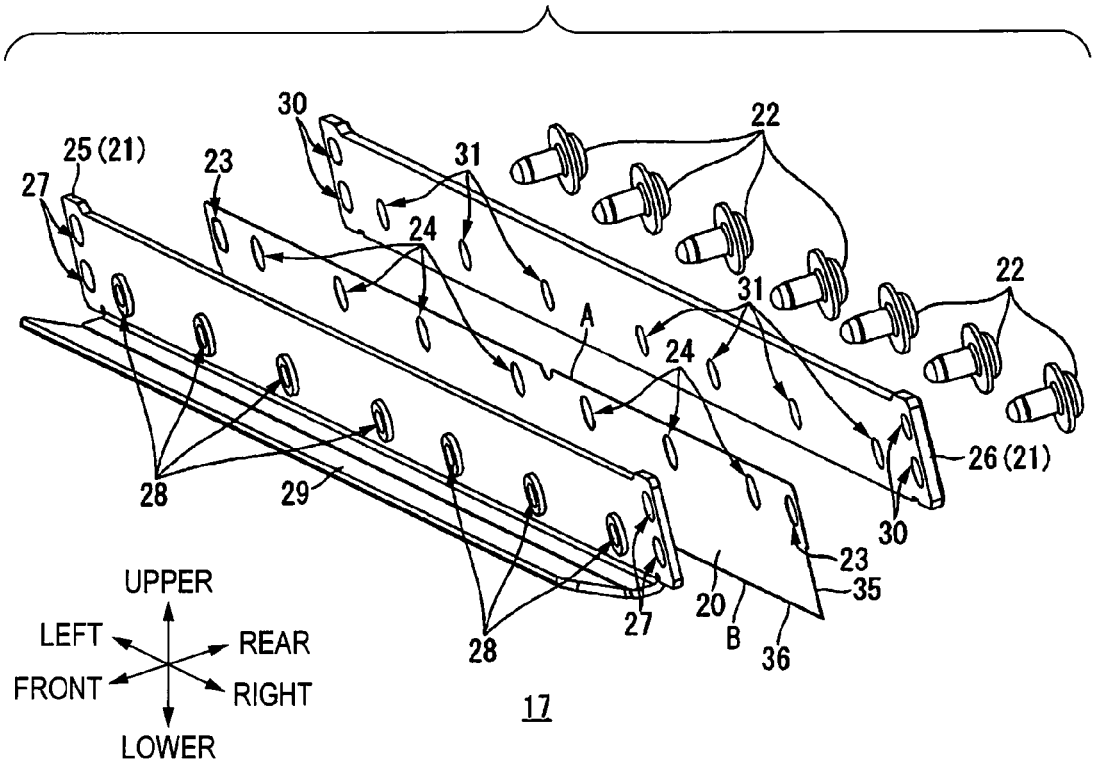
FIG. 4 is an exploded perspective view of the blade unit.

As shown in FIG. 4, the blade 20 has a rectangular plate shape that is long in the width direction, and is thin in the front-rear direction. The blade 20 is formed of a leaf spring member that is made of, for example, metal such as stainless steel. The blade has a certain degree of elasticity. The blade 20 has a thickness T (see FIG. 2B) in the range of 60 μm to 150 μm.

One first through hole 23 is formed at each of both end portions of the upper end portion of the blade 20 in the width direction, and a plurality of (here, seven) second through holes 24 is formed at a portion of the blade between the left and right first through holes 23 at intervals in the width direction. The first and second through holes 23 and 24 pass through the blade 20 in a thickness direction (the front-rear direction).

Figure 2B:
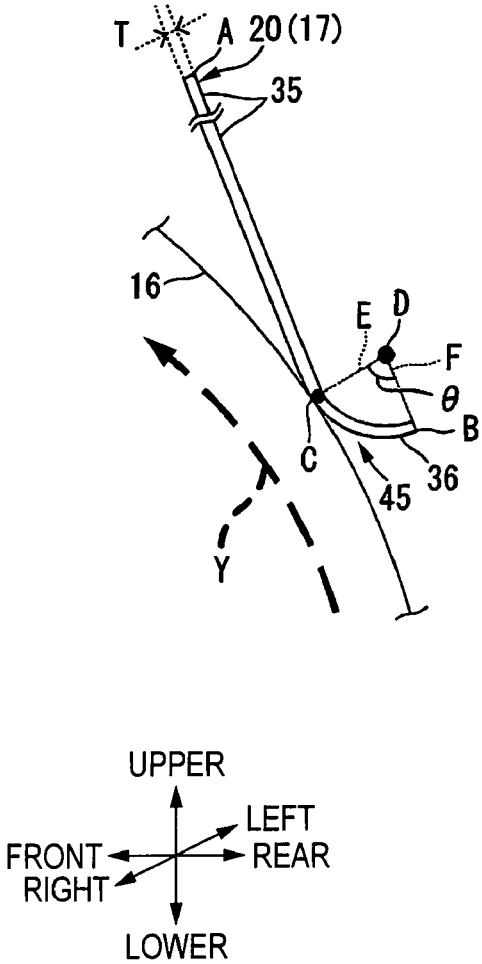
FIG. 2B is a view showing a blade of FIG. 2A.

Although not shown clearly in FIG. 4, the entire lower end portion of the blade 20 in the width direction is bent toward the rear side in an arc shape (see FIG. 2B). The vicinity of the lower end portion of the blade 20 will be described in detail below.

The pair of holders 21 is disposed in the front-rear direction so that the blade 20 is interposed between the holders 21 in the front-rear direction. The pair of holders 21 include a front holder 25 which is provided on the front side and a rear holder 26 which is provided on the rear side.

Similarly to the blade 20, the front holder 25 has a rectangular plate shape that is long in the width direction. However, the thickness of the front holder 25 is larger than that of the blade 20.

Two third through holes 27 are formed at each of both end portions of the front holder 25 in the width direction so as to be arranged in the upper-lower direction. Seven fourth through holes 28, the number of which is equal to the number of the second through holes 24, are formed at intervals in the width direction at a portion of the front holder 25 between the lower third through holes 27 formed at the left and right end portions of the front holder 25. The third and fourth through holes 27 and 28 pass through the front holder 25 in a thickness direction (the front-rear direction).

An extension portion 29 is connected to almost the entire portion of the lower end of the front holder 25 between the left and right third through holes 27. In FIG. 4, the extension portion 29 extends from the lower end of the front holder 25 toward the front upper side. Accordingly, assuming that the extension portion 29 is a part of the front holder 25, the front holder has a substantially J shape when the entire front holder 25 is seen from the right side (see FIG. 2A).

Similarly to the front holder 25 (a portion except for the extension portion 29), the rear holder 26 has a rectangular plate shape that is long in the width direction. The thickness of the rear holder 26 is substantially equal to that of the front holder 25.

Two fifth through holes 30 are formed at each of both end portions of the rear holder 26 in the width direction so as to be arranged in the upper-lower direction.

Seven sixth through holes 31, the number of which is equal to the number of the second through holes 24, are formed at intervals in the width direction at a portion of the rear holder 26 between the lower fifth through holes 30 formed at the left and right end portions of the rear holder 26. The fifth and sixth through holes 30 and 31 pass through the rear holder 26 in a thickness direction (the front-rear direction).

There are provided seven screws 22, the number of which is equal to the number of the second through holes 24.

The assembling of the blade unit 17 and the mounting of the blade unit on the case 2 will be described below.

First, as shown in FIG. 4, the front holder 25, the blade 20, the rear holder 26, and the screws 22 are provided in this order from the front side.

Figure 3:
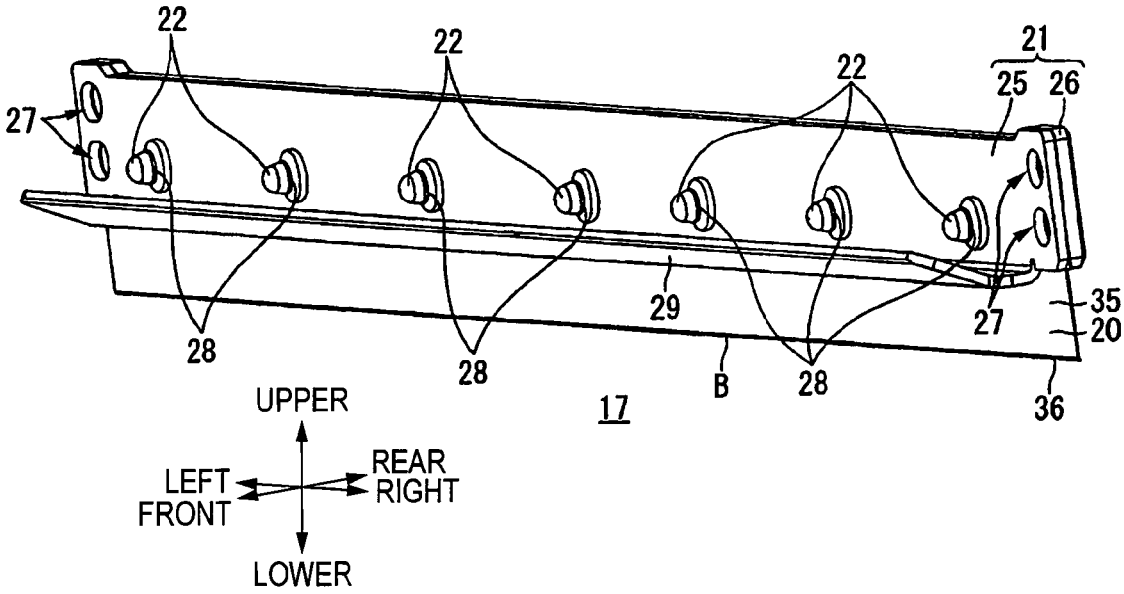
FIG. 3 is a perspective view of the blade unit.

Then, as shown in FIG. 3, the upper portion of the blade 20 is interposed between the front-rear holders 25 and 26 in the front-rear direction. In this state, each of the first through holes 23 of the blade 20 corresponds to the lower third through holes 27 of two third through holes 27 that are formed at the same side of the front holder 25 in the width direction (opposes the lower third through holes in the front-rear direction), and corresponds to the lower fifth through hole 30 of two fifth through holes 30 that are formed at the same side of the rear holder 26 in the width direction (see also FIG. 4). Furthermore, the second through holes 24 of the blade 20 correspond to the fourth through holes 28 that are positioned at the same positions of the front holder 25 in the width direction, and correspond to the sixth through holes 31 that are positioned at the same positions of the rear holder 26 in the width direction (see also FIG. 4).

After that, the respective screws 22 are inserted into the sixth through holes 31, the second through holes 24, and the fourth through holes 28, which are positioned at the same positions (correspond to one another) in the width direction, in this order from the rear side, and are fixed to the front holder 25 (see also FIGS. 2 and 4).

Accordingly, the upper portion of the blade 20 is fixed while being interposed between the front-rear holders 25 and 26, so that the assembling of the blade unit 17 is completed. Meanwhile, in this state, a gap between the upper portion of the blade 20 and the front holder 25 and a gap between the upper portion of the blade 20 and the rear holder 26 may be closed by a seal or the like (not shown).

Referring to FIG. 1, the completed blade unit 17 is installed between the left and right inclined walls 3A of the front end of the top wall 3 (see also FIG. 5), and is mounted on the respective inclined walls 3A from the front side.

Specifically, a boss 32, which protrudes toward the front side, is provided on the front surface of each of the inclined walls 3A. Each of the bosses 32 is inserted into the upper fifth and third through holes 30 and 27 of the two fifth through holes 30 and two third through holes 27, which are positioned at the same positions in the width direction, in this order from the rear side (see also FIGS. 3, 4, and 5). Accordingly, the blade unit 17 is positioned relative to the left and right inclined walls 3A (see also FIG. 5).

Figure 5:
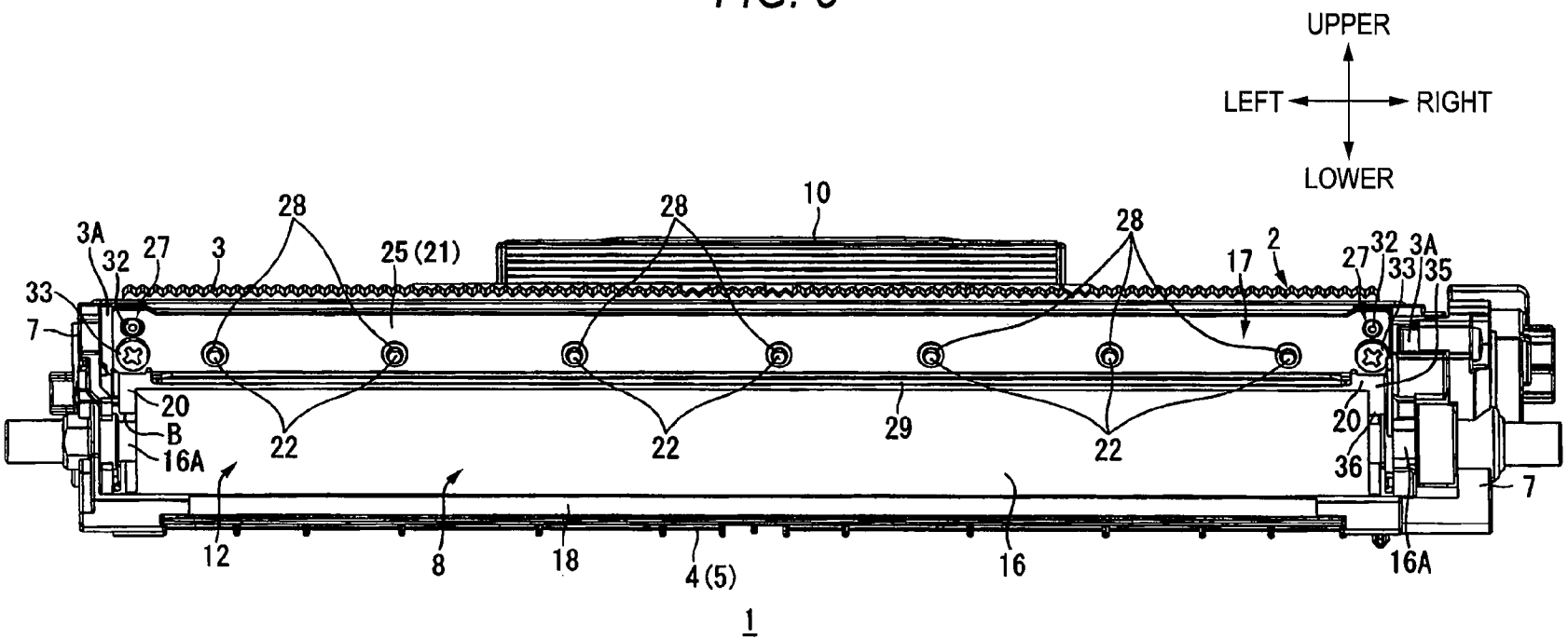
FIG. 5 is a front view of the developing cartridge.

In this state, screws 33 are inserted into the third through holes 27 (the lower third through holes 27), the first through holes 23, and the fifth through holes 30 (the lower fifth through holes 30), which are positioned at the same positions (correspond to one another) in the width direction, from the front side, and are fixed to the inclined walls 3A that are positioned at the same positions in the width direction (see also FIGS. 3, 4, and 5). Accordingly, the blade unit 17 is mounted on (fixed to) the respective inclined walls 3A (that is, the case 2).

In the state where the blade unit 17 is mounted on the case 2, only the lower end portion of the blade 20 of the blade unit 17 is in contact with the outer peripheral surface of the developing roller 16. Specifically, in this state, the blade 20 extends toward the rear lower side substantially along the inclined wall 3A.

The blade 20 includes a base end A that is provided at the upper end thereof and is supported together with the holder 21 by the case 2 (the inclined wall 3A), and a tip end B that is provided at the lower end thereof (see also FIG. 4).

As described above, the entire lower end portion of the blade 20 in the width direction is bent toward the rear side in an arc shape as shown in FIG. 2B. Specifically, as seen in the width direction, the blade 20 includes a linear portion 35 that linearly extends from the base end A toward the rear lower side, and a bent portion 36 that is bent rearward in an arc shape from the lower end of the linear portion 35 as a bending start portion C toward the tip end B at a predetermined radius of curvature. The upper end of the linear portion 35 is the base end A of the blade 20, and the rear end of the bent portion 36 is the tip end B of the blade 20.

The bent portion 36 is formed between the bending start portion C and the tip end B. As extending from the bending start portion C toward the tip end B, the bent portion is separated from the outer peripheral surface of the developing roller 16. The radius of curvature of the bent portion 36 is set in the range of 0.2 mm to 0.4 mm.

Here, in FIG. 2B, the center of curvature of the bent portion 36, which is seen in the width direction, is denoted by reference numeral D. As seen in the width direction, a segment which connects the bending start portion C with the center of curvature D is referred to as a first reference segment E, and a segment which connects the tip end B with the center of curvature D is referred to as a second reference segment F. The length of the first reference segment E is equal to that of the second reference segment F, and corresponds to the radius of curvature of the bent portion 36. As shown in FIG. 2B, as seen in the width direction, an angle defined between the first and second reference segments E and F is denoted by reference character θ. The angle θ is set in the range of 45° to 90°.

The bending start portion C of the blade 20 becomes a contact portion and is in press contact with the entire portion of the developing roller in the width direction, which corresponds to one point on the outer peripheral surface of the developing roller 16 in the circumferential direction, from the rear upper side by the electric force of the blade 20. In other words, a portion of the blade 20 between the base end A and the tip end B is in contact with the outer peripheral surface of the developing roller 16. Accordingly, the inside of the developing chamber 12 is partitioned into an area that is provided on the front side of the blade 20 (close to the supply port 8), and an area that is provided on the rear side of the blade 20 (close to the communication port 14) (see FIG. 1).

Here, if the predetermined rotational direction Y of the developing roller 16 (which is a counterclockwise direction as seen from the right side and corresponds to the arrow shown by a thick broken line) is used as the basis, the tip end B of the blade 20 is positioned upstream of the base end A of the blade 20 in the rotational direction Y.

2. Operation of Developing Cartridge during Formation of Image

Referring to FIG. 1, as described above, a driving force is input to each of the rotating shaft 13A of the agitator 13, the rotating shaft 15A of the supply roller 15, and the rotating shaft 16A of the developing roller 16 during the formation of an image, so that each of the agitator 13, the supply roller 15, and the developing roller 16 rotates.

Specifically, at first, the agitator 13 rotates in the clockwise direction as seen from the right side as described above, so that the agitating blade 13B of the agitator 13 revolves on the rotating shaft 13A in the toner storage chamber 11 in the clockwise direction as seen from the right side. Therefore, the toner (pulverized toner) stored in the toner storage chamber 11 is agitated by the agitating blade 13B, and is discharged to the developing chamber 12, which is provided on the front side, through the communication port 14.

The toner, which is discharged to the developing chamber 12 through the communication port 14, is supplied to the outer peripheral surface of the supply roller 15 and is supplied to the outer peripheral surface of the developing roller 16, to which a developing bias is applied, by the rotation of the supply roller 15 in the rotational direction X. At this time, toner is frictionally charged to a positive polarity at a portion where the outer peripheral surface of the supply roller 15 and the outer peripheral surface of the developing roller 16 are in contact with each other.

Further, referring to FIG. 2B, the toner, which is supplied to the outer peripheral surface of the developing roller 16, reaches a portion (that is, the bending start portion C) where the bending start portion C of the blade 20 is in press contact with the outer peripheral surface of the developing roller 16 as the developing roller 16 rotates in the rotational direction Y.

When passing between the bending start portion C and the outer peripheral surface of the developing roller 16, the toner, which has reached the bending start portion C, is formed into a thin layer and is held on the outer peripheral surface of the developing roller 16.

The toner, which cannot pass between the bending start portion C and the outer peripheral surface of the developing roller 16, is scraped off by the bent portion 36 of the blade 20. The scraped toner is accumulated in an upstream area 45 of the bent portion 36 in the rotational direction Y of the developing roller 16 (an area that is formed between the bent portion 36 and the outer peripheral surface of the developing roller 16 and gradually becomes narrow toward the bending start portion C, as seen in the width direction).

As described above, the bending start portion C of the blade 20 (between the base end A and the tip end B) is in contact with the outer peripheral surface of the developing roller 16, so that the blade regulates the thickness of the toner on the outer peripheral surface of the developing roller 16.

Further, referring to FIG. 1, the thin layer made of the toner, which passes between the bending start portion C and the outer peripheral surface of the developing roller 16, is supplied to the electrostatic latent image formed on the surface of the photosensitive member 40 as the developing roller 16 rotates in the rotational direction Y.

Specifically, the surface of the photosensitive member 40 is uniformly and previously charged to a positive polarity. Accordingly, the surface of the photosensitive member is exposed to laser beams or the like, so that an electrostatic latent image is formed on the surface of the photosensitive member 40. The electrostatic latent image corresponds to an exposed portion, the electrical potential of which is lowered by exposure, of the surface of the photosensitive member 40 that is uniformly charged to a positive polarity.

Further, when being in contact with the surface of the photosensitive member 40 by the rotation of the developing roller 16, the toner, which is held on the outer peripheral surface of the developing roller 16 and charged to a positive polarity, is supplied to the electrostatic latent image (the exposed portion of which the electrical potential is lowered) formed on the surface of the photosensitive member 40. Accordingly, the electrostatic latent image formed on the photosensitive member 40 is developed, so that a toner image formed by reversal development is held on the surface of the photosensitive member 40.

3. Blade

Referring to FIG. 2B, when the blade 20 according to an exemplary embodiment of the present invention is used, as described above, the toner, which cannot pass between the bending start portion C and the outer peripheral surface of the developing roller 16 and is scraped off by the bent portion 36 of the blade 20, is accumulated by an appropriate amount in the upstream area 45 of the bent portion 36 in the rotational direction Y of the developing roller 16.

Since an appropriate amount of toner is accumulated in the upstream area 45, an inappropriate thin portion in the width direction is not formed in the thin layer made of the toner, which passes between the bending start portion C and the outer peripheral surface of the developing roller 16, in comparison with when toner is not accumulated in the upstream area 45. That is, it is possible to form a thin toner layer to have a uniform thickness in the width direction.

Accordingly, the electrostatic latent image formed on the photosensitive member 40 (see FIG. 1) is stably developed by the thin layer made of toner on the entire portion in the width direction. Therefore, a scratched portion does not exist on a solid print in the toner image that is transferred to a sheet thereafter, and it is possible to achieve the high-quality image formation.

Further, since an appropriate amount of toner is accumulated in the upstream area 45, ghost (the variation in the toner density) does not exist in the toner image transferred to a sheet, so that it is possible to achieve the high-quality image formation in comparison with the case where toner is accumulated by more than an appropriate amount in the upstream area 45.

The cause of the generation of a ghost can be considered as follows. That is, at first, the property (e.g. a charged amount) of the toner (retained toner), which is accumulated by more than an appropriate amount in the upstream area 45, is changed depending on the elapsed retaining time of toner in the upstream area 45. Then, when the retained toner, the property of which has been changed as described above, passes between the bending start portion C and the outer peripheral surface of the developing roller 16, the charged amount becomes different between the retained toner and the other of toner than the retained toner in the thin toner layer, so that the property of the thin toner layer becomes non-uniform. That is, it can be considered that the ghost is generated because an electrostatic latent image is developed by the thin layer made of the toner, the property of which is non-uniform as described above.

That is, according to an exemplary embodiment of the present invention, it is possible to retain an appropriate amount of toner without excess and lack in the upstream area 45 of the bent portion 36. Therefore, it is possible to suppress the generation of a ghost caused by the blade 20 while achieving a solid print without a scratched portion. According to an exemplary embodiment of the present invention, since the tip end B of the blade 20 corresponds to a bending end portion of the bent portion 36, it is possible to accumulate an appropriate amount of toner in the upstream area 45.

If the blade includes a portion which linearly extends from the bending end portion of the bent portion 36 and is connected to the tip end B unlike the exemplary embodiment of the present invention; this portion is likely to stop toner. Accordingly, the toner is accumulated in the upstream area 45 by an amount significantly exceeding an appropriate amount. Therefore, it is difficult to suppress the generation of a ghost.

The meaning of the respective dimensions of the blade 20, which are set as described above, will be described below with reference to the results of the following experiments.

This experiment was performed to examine the generation of a ghost as the respective dimensions of the blade 20 (e.g. the radius of curvature of the bent portion 36 and the angle θ) were changed.

(1) Experimental Conditions

Image forming apparatus used in the experiment: HL-2140 (laser printer) manufactured by Brother Industries, Ltd.

Toner: positively chargeable non-magnetic one-component pulverized toner and polymerized toner Pulverized toner is used in the developing cartridge 1 according to the exemplary embodiment as described above, however, the experiment was performed using polymerized toner manufactured by a so-called polymerization method as well as pulverized toner for comparison. The circularity of pulverized toner is smaller than 0.968, and the circularity of polymerized toner is 0.9998. That is, the shape of polymerized toner is close to a true sphere, and the shape of pulverized toner is coarse. Therefore, pulverized toner is inferior to polymerized toner in terms of fluidity. Accordingly, pulverized toner is likely to be accumulated in the upstream area 45, so that pulverized toner is likely to generate a ghost.

Device for measuring the angle θ and the radius of curvature of the bent portion 36: SURFCOM5000DX manufactured by Tokyo Seimitsu Co., Ltd.

Free length of the blade 20: 8 mm

Referring to FIG. 2A, the free length of the blade 20 is the length of the lower portion of the blade 20, which is not interposed between the pair of holders 21, in a direction directing the rear lower side.

Deflection of the blade 20: 0.8 mm

The deflection of the blade 20 indicates the deviation of the tip end B of the blade 20 before and after the blade 20 (blade unit 17) is mounted on the case 2, specifically, before and after the bending start portion C of the blade 20 is in press contact with the outer peripheral surface of the developing roller 16. That is, in the case of any blade 20 used in this experiment, when the blade 20 (blade unit 17) is mounted on the case 2, the tip end B of the blade 20 is deviated by 0.8 mm toward the rear upper side in comparison with before the blade 20 is mounted on the case. 2, so that the bending start portion C of the blade 20 is in press contact with the outer peripheral surface of the developing roller 16 by a force for returning the tip end B of the blade 20 (see FIG. 2B). Therefore, the force for making the bending start portion C of the blade 20 being in press contact with the outer peripheral surface of the developing roller 16 was the same among the blade 20 used in this experiment. Meanwhile, an error in the deflection can be in the range of ±0.2 mm, but this error is not likely to affect an error in the force for making the bending start portion C of the blade 20 being in press contact with the outer peripheral surface of the developing roller 16. The material of the blade 20 was same among all the blades 20 used in the experiment.

The timing for performing the experiment: early morning

Early morning is a time zone where toner is hardly charged with electricity. If an image is formed in the early morning since toner is hardly charged with electricity, a ghost is likely to be generated. That is, the experiment was performed under a severe condition where a ghost is likely to be generated.

(2) Experimental Method

Figure 6:
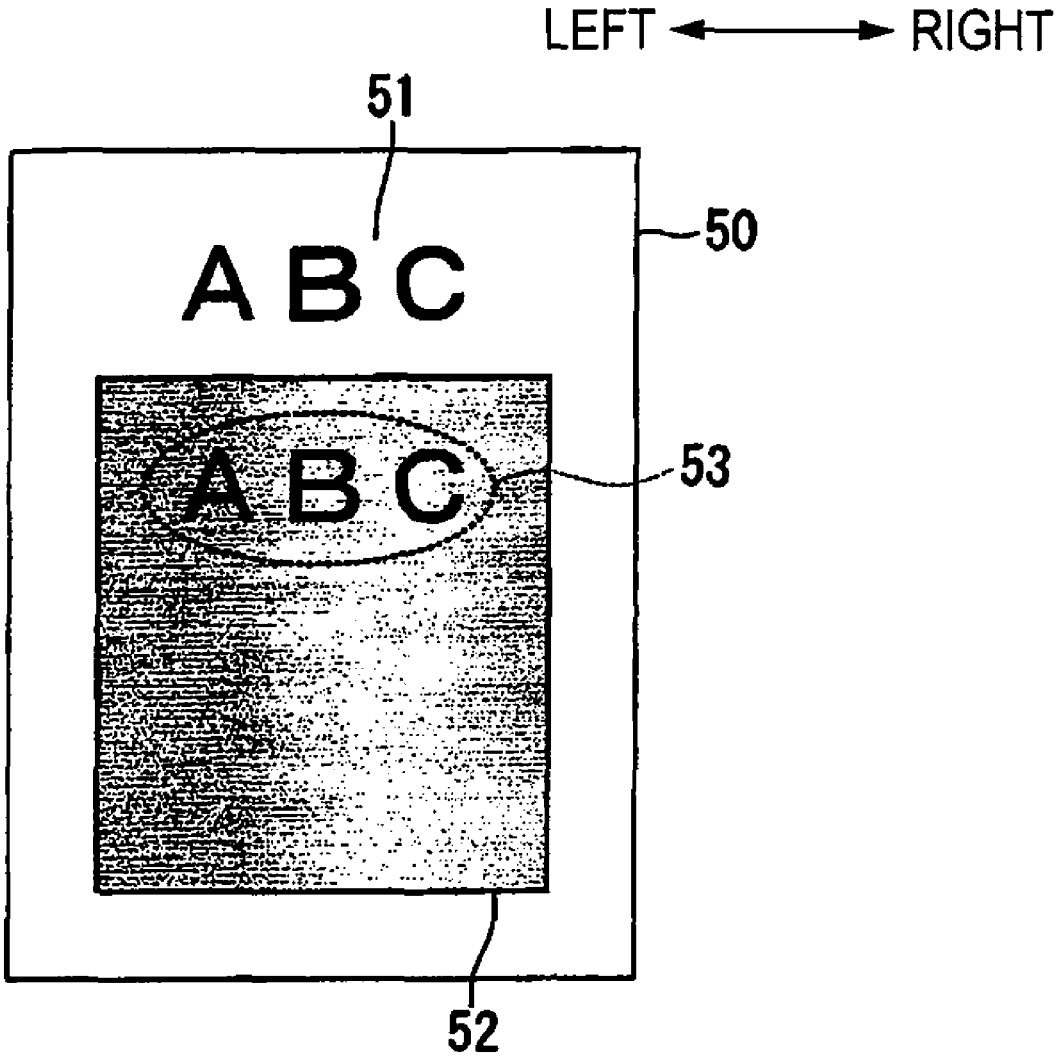
FIG. 6 is a view showing a sheet that is used in an experiment.

One experiment was performed using one sheet 50 shown in FIG. 6 for each of blades 20 having the above-described dimensions and different radius of curvature of the bent portion 36 and different angle θ.

First, arbitrary characters 51 (here, "ABC") were printed on one sheet 50. Subsequently, a solid print of a halftone (see a portion denoted by reference numeral 52 in FIG. 6) was formed during one or more rotations of the developing roller 16 (see FIG. 1).

Accordingly, characters 51 and a halftone portion 52 were printed on one sheet 50 so as to be arranged in the longitudinal direction (conveying direction) of the sheet. Then, it was visually observed whether the characters (ABC) same as the characters 51 appeared in the halftone portion 52 as a ghost 53 (see a portion of the halftone portion 52 surrounded by a dashed line). If the ghost could be clearly observed, an experimental result was represented by "c (a ghost was generated)". If the ghost could not be observed, an experimental result was represented by "b (a ghost was not generated)". In addition, if not only a ghost but also the slight variation in the toner density could not be observed (if the image quality of the halftone portion 52 was very high) in the experimental result of "b", an experimental result was represented by "a". If the experimental result corresponded to "b", not only a ghost but also a scratched portion was not generated in the halftone portion 52.

(3) Experimental Result

In the following description, Table 1 shows Experimental results 1 when the radius of curvature of the bent portion 36 (which is the length of the first or second reference segments E or F, see FIG. 2B) is changed. Table 2 shows Experimental results 2 when the angle θ (which is defined by the first and second reference segments E and F, see FIG. 2B) is changed.

(3-1) Experimental Result 1

Experimental results 1 are shown in Table 1. In this experiment, the angle θ is constant, that is, 90° in all blades 20 having different radiuses of curvature of the bent portions 36.

TABLE 1

| DATA No. | RADIUS OF CURVATURE (mm) | RESULT PULVERIZED TONER | RESULT POLYMERIZED TONER |
|---|---|---|---|
| 1 | 0.19 | c | a |
| 2 | 0.20 | b | a |

TABLE 1-continued

| DATA No. | RADIUS OF CURVATURE (mm) | RESULT PULVERIZED TONER | RESULT POLYMERIZED TONER |
|---|---|---|---|
| 3 | 0.28 | a | a |
| 4 | 0.38 | a | a |
| 5 | 0.39 | b | a |
| 6 | 0.40 | b | a |
| 7 | 0.41 | c | c |
| 8 | 0.52 | c | c |
| 9 | 0.53 | c | c |

As shown in Table 1, it is understood that a ghost was not generated if the radius of curvature of the bent portion 36 was in the range from 0.2 mm to 0.4 mm in the case of pulverized toner. In particular, if the radius of curvature of the bent portion 36 was in the range from 0.28 mm to 0.38 mm, it was possible to achieve the high-quality image formation where even the slight variation in the toner density could not be observed.

Meanwhile, if the radius of curvature of the bent portion 36 was smaller than 0.2 mm and if the radius of curvature of the bent portion was larger than 0.4 mm, a ghost was generated.

Moreover, if polymerized toner, which was superior to pulverized toner in terms of fluidity, was used, it was possible to achieve the high-quality image formation where a ghost was not generated even when a ghost was generated if pulverized toner was used (the radius of curvature of the bent portion 36 is, for example, 0.2 mm or less).

(3-2) Experimental result 2

Experimental results 2 are shown in Table 2. In this experiment, the radius of curvature of the bent portions 36 is constant, that is, 0.3 mm in the case of any blades 20 having different angles θ.

TABLE 2

| DATA No. | ANGLE (°) | RESULT PULVERIZED TONER | RESULT POLYMERIZED TONER |
|---|---|---|---|
| 10 | 26.2 | — | — |
| 11 | 40 | — | — |
| 12 | 43 | — | b |
| 13 | 45 | b | a |
| 14 | 47.2 | a | a |
| 15 | 58.6 | a | a |
| 16 | 90 | a | a |
| 17 | 91 | c | c |

As shown in Table 2, it is understood that a ghost was not generated if the angle θ was in the range from 45° to 90° in the case of pulverized toner. In particular, if the angle θ was in the range from 47.2° to 90°, it was possible to achieve the high-quality image formation.

Meanwhile, if the angle θ was smaller than 45°, the amount of toner accumulated in the upstream area 45 (see FIG. 2B) (in other words, the amount of toner passing between the bending start portion C and the outer peripheral surface of the developing roller 16) was lacking, so that scratched portions were generated in the halftone portion 52 (FIG. 6). Therefore, it was not possible to observe whether a ghost was formed. When the ghost could not be observed since the scratched portions were formed in the halftone portion 52, the experimental result was represented by "-(unknown)".

From the experimental results of Tables 1 and 2, if the radius of curvature of the bent portion 36 of the blade 20 is in the range of 0.2 mm to 0.4 mm, and the angle θ is in the range of 45° to 90° as in the exemplary embodiments of the present invention, even though pulverized toner having the circularity smaller than 0.968 is used, it is possible to suppress the generation of a ghost (see also FIG. 2B).

Further, as described above, if the blade 20 has the above-described structure, it is possible to suppress the generation of a ghost and to retain an appropriate amount of toner without excess and lack in the upstream area 45 of the bent portion 36 (see FIG. 2B). Accordingly, it is possible also to achieve a solid print without a scratched portion.

A blade 20 may have a relatively large thickness T (see FIG. 2B). In this case, the surface of the tip end (lower end portion) of the blade 20, which opposes the outer peripheral surface of the developing roller 16, may be curved by polishing or forming into an arc shape as the above-described bent portion 36. In this case, it is also possible to obtain the same advantages as the above-described advantages.

However, according to the exemplary embodiments of the present invention, if the blade 20 is formed into a thin plate shape, it is possible to easily form a bent portion 36 (see FIG. 2B), which has a minute and fine shape, by bending work. In particular, if the thickness T (see FIG. 2B) of the blade 20 is in the range from 60 μm to 150 μm, it is possible to easily form the bent portion 36 while making the bent portion to have minimum necessary strength. Accordingly, it is possible to improve the productivity of the blade 20.

As described above, the exemplary embodiment of the present invention is particularly effective in achieving a solid print without a scratched portion and suppressing the generation of a ghost, which is caused by a blade 20 when pulverized toner having relatively low circularity (poor fluidity) is used. However, the present invention may also be applied to all kinds of developing devices that form an image by using powder developer (polymerized toner or the like) other than pulverized toner.

What is claimed is:

1. A developing device comprising:

a case;

a developing roller supported by the case to be rotatable in a rotational direction about a rotating axis, and is configured to hold toner on an outer peripheral surface thereof to supply the toner to an electrostatic latent image formed on a photosensitive member; and a blade having a base end supported by the case and a tip end provided upstream of the base end in the rotational direction, wherein the blade is configured to contact the outer peripheral surface of the developing roller at a contact portion between the base end and the tip end so as to regulate a thickness of the toner held on the developing roller, wherein the blade further includes a bent portion that is provided between the tip end and the contact portion, and is bent from the contact portion as a bending start portion at a radius of curvature in the range of 0.2 mm to 0.4 mm so as to be separated from the outer peripheral surface of the developing roller toward the tip end, and wherein as seen in a direction along the rotating axis of the developing roller, an angle, defined between a first reference segment connecting the contact portion with a center of curvature of the bent portion and a second reference segment connecting the tip end with the center of curvature of the bent portion, is in the range of 45° to 90°.

2. The developing device according to claim 1, wherein the thickness of the blade is in the range of 60 μm to 150 μm.

3. The developing device according to claim 1, wherein the toner includes pulverized toner.

4. The developing device according to claim 1, wherein a circularity of the toner is smaller than 0.968.

5. The developing device according to claim 1, wherein the radius of curvature of the bent portion is in the range of 0.28 mm to 0.38 mm.

6. The developing device according to claim 1, wherein the angle defined by the first reference segment and the second reference segment is in the range of 47.2° to 90°.

7. An image forming apparatus comprising:

a photosensitive member; and a developing device including:

a case;

a developing roller supported by the case to be rotatable in a rotational direction about a rotating axis, and is configured to hold toner on an outer peripheral surface thereof to supply the toner to an electrostatic latent image formed on the photosensitive member; and a blade having a base end supported by the case and a tip end provided upstream of the base end in the rotational direction, wherein the blade is configured to contact the outer peripheral surface of the developing roller at a contact portion between the base end and the tip end so as to regulate a thickness of the toner held on the developing roller, wherein the blade further includes a bent portion provided between the tip end and the contact portion, and is bent from the contact portion as a bending start portion at a radius of curvature in the range of 0.2 mm to 0.4 mm so as to be separated from the outer peripheral surface of the developing roller toward the tip end, and wherein as seen in a direction along the rotating axis of the developing roller, an angle, defined between a first reference segment connecting the contact portion with a center of curvature of the bent portion and a second reference segment connecting the tip end with the center of curvature of the bent portion, is in the range of 45° to 90°.

* * * * *